US008605019B2

(12) United States Patent
Suzuki et al.

(10) Patent No.: US 8,605,019 B2
(45) Date of Patent: Dec. 10, 2013

(54) DISPLAY DEVICE AND DISPLAY DEVICE DRIVING METHOD, AND DISPLAY DRIVING CONTROL METHOD

(75) Inventors: Hiroto Suzuki, Osaka (JP); Fumikazu Shimoshikiryoh, Osaka (JP); Masae Kawabata, Osaka (JP); Kentarou Irie, Osaka (JP); Toshikazu Tsuchiya, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 188 days.

(21) Appl. No.: 12/737,618

(22) PCT Filed: Jun. 24, 2009

(86) PCT No.: PCT/JP2009/061519

§ 371 (c)(1),
(2), (4) Date: Jan. 31, 2011

(87) PCT Pub. No.: WO2010/038524

PCT Pub. Date: Apr. 8, 2010

(65) Prior Publication Data

US 2011/0122163 A1 May 26, 2011

(30) Foreign Application Priority Data

Sep. 30, 2008 (JP) ..... 2008-254394

(51) Int. Cl.
*G09G 3/36* (2006.01)
*G09G 5/10* (2006.01)

(52) U.S. Cl.
USPC ..... 345/89; 345/690; 345/96

(58) Field of Classification Search
USPC ..... 345/87–104, 204–699, 38; 349/143–144
See application file for complete search history.

(56) References Cited

U.S. PATENT DOCUMENTS 7,084,848 B2 8/2006 Senda et al.
7,259,739 B2 * 8/2007 Yun et al. ..... 345/93
(Continued)

FOREIGN PATENT DOCUMENTS

CN 1425948 6/2003
JP 2002236474 A 8/2002
(Continued)

OTHER PUBLICATIONS

Russian Notice of Allowance dated Apr. 5, 2012 and English translation thereof.

(Continued)

*Primary Examiner* — Amr Awad
*Assistant Examiner* — Roberto Flores
(74) *Attorney, Agent, or Firm* — Harness, Dickey & Pierce

(57) ABSTRACT

A display device of at least one embodiment of the present invention includes at least one correcting device for, in a case where a first data signal is to be written to a first pixel during a unique horizontal period, (i) carrying out a first gray scale correction with respect to display data corresponding to the first data signal to be written to the first pixel during the unique horizontal period, and (ii) supplying the display data to a display driver, the unique horizontal period being a first horizontal period for one of the driving signals supplied to respective storage capacitor bus lines which first horizontal period occurs a first number of horizontal periods after an initial horizontal period included in a given cyclic term for either or both of a binary level, the given cyclic term being a second cyclic term for the driving signals which second cyclic term occurs a second number of cyclic terms after a first cyclic term including a horizontal period during which the data signals start to be written to the pixels, the first number being different from a corresponding number for any other of the driving signals.

17 Claims, 10 Drawing Sheets

(56) References Cited

U.S. PATENT DOCUMENTS

| | | | | |
|---|---|---|---|---|
| 7,477,224 | B2 * | 1/2009 | Song et al. | 345/96 |
| 8,207,926 | B2 * | 6/2012 | Shimoshikiryoh | 345/89 |
| 2002/0109656 | A1 | 8/2002 | Yoshikawa | |
| 2003/0090452 | A1 * | 5/2003 | Uchino et al. | 345/96 |
| 2003/0107543 | A1 | 6/2003 | Nakano et al. | |
| 2003/0227429 | A1 | 12/2003 | Shimoshikiryo | |
| 2005/0110737 | A1 | 5/2005 | Hosotani | |
| 2005/0122441 | A1 * | 6/2005 | Shimoshikiryoh | 349/38 |
| 2005/0213015 | A1 | 9/2005 | Shimoshikiryo | |
| 2005/0219161 | A1 | 10/2005 | Aoki | |
| 2006/0097972 | A1 * | 5/2006 | Takeuchi et al. | 345/90 |
| 2006/0256271 | A1 | 11/2006 | Shimoshikiryo | |
| 2007/0091043 | A1 | 4/2007 | Rho et al. | |
| 2007/0097054 | A1 * | 5/2007 | Cheng | 345/96 |
| 2008/0001881 | A1 * | 1/2008 | Baba et al. | 345/89 |
| 2008/0062101 | A1 * | 3/2008 | Minami et al. | 345/89 |
| 2008/0106660 | A1 * | 5/2008 | Kitayama et al. | 349/39 |
| 2008/0150874 | A1 * | 6/2008 | Kida et al. | 345/100 |
| 2009/0046048 | A1 * | 2/2009 | Shimoshikiryoh | 345/99 |
| 2009/0195487 | A1 | 8/2009 | Shimoshikiryoh et al. | |
| 2009/0268110 | A1 | 10/2009 | Kitayama et al. | |
| 2010/0156963 | A1 | 6/2010 | Shiomi | |

FOREIGN PATENT DOCUMENTS

| | | | |
|---|---|---|---|
| JP | 200462146 | A | 2/2004 |
| JP | 2005156661 | A | 6/2005 |
| RU | 2 241 276 | | 11/2004 |
| WO | WO-2005073953 | A1 | 8/2005 |
| WO | WO-2006098328 | A1 | 9/2006 |
| WO | WO-2008023602 | A1 | 2/2008 |
| WO | WO-2008090660 | A1 | 7/2008 |

OTHER PUBLICATIONS

English language International Search Report.
Japanese language International Search Report.

* cited by examiner

| Input Gray Scale | Correction Value |
|---|---|
| 1023 ~ 512 | 0 |
| 511 ~ 40 | +0.75 |
| 39 ~ 10 | +0.25 |
| 9 ~ 0 | 0 |

FIG. 6

(a)

| |
|---|
| 1st Line: Correction Value = +1 (In 1024 Gray Scales) |
| 2nd Line: Correction Value = +0.5 (In 1024 Gray Scales) |
| ▪ |
| ▪ |
| 96th Line: Correction Value = −1 (In 1024 Gray Scales) |
| 1st Line: Correction Value = +1 (In 1024 Gray Scales) |
| 2nd Line: Correction Value = +0.5 (In 1024 Gray Scales) |
| ▪ |
| ▪ |
| 96th Line: Correction Value = −1 (In 1024 Gray Scales) |

Same Cycle Repeated Afterwards (b)

Luminance (In 1024 Gray Scales Independently For R, G, And B)

| | | | | | | | |
|---|---|---|---|---|---|---|---|
| 0 | 0 | 0 | 0 | 0 | 0 | 0 | 0 |
| 1 | 1/2 | 1/4 | 0 | 0 | 1/4 | 1/2 | 1 |
| 1/2 | 1/4 | 0 | 0 | 0 | 0 | 1/4 | 1/2 |
| 1/4 | 0 | 0 | 0 | 0 | 0 | 0 | 1/4 |

1023
512
64
40
0

512 960 1408 1920

Location In Horizontal Direction

DISPLAY DEVICE AND DISPLAY DEVICE DRIVING METHOD, AND DISPLAY DRIVING CONTROL METHOD

TECHNICAL FIELD

The present invention relates to a display device in which storage capacitor voltages are applied to storage capacitor bus lines via a plurality of CS trunk lines.

BACKGROUND ART

An example of a liquid crystal display device which has a γ characteristic with a reduced viewing angle dependence is a liquid crystal display device which employs a multi-pixel driving method. Multi-pixel driving is carried out with use of pixels each made up of at least two sub-pixels having luminances different from each other. As such, the multi-pixel driving achieves an improved viewing angle characteristic, that is, a γ characteristic with a reduced viewing angle dependence.

FIG. 7 illustrates an example configuration of a pixel included in a liquid crystal display device which employs the multi-pixel driving method (see, for example, Patent Literature 1).

The pixel P is divided into two sub-pixels sp1 and sp2. The sub-pixel sp1 includes: a TFT 16*a*; a sub-pixel electrode 18*a*; and a storage capacitor 22*a*. The sub-pixel sp2 includes a TFT 16*b*; a sub-pixel electrode 18*b*; and a storage capacitor 22*b*.

The TFTs 16*a* and 16*b* have (i) respective gate electrodes both connected to an identical gate bus line GL and (ii) respective source electrodes both connected to an identical source bus line SL. The storage capacitor 22*a* is formed between the sub-pixel electrode 18*a* and a storage capacitor bus line CsL1. The storage capacitor 22*b* is formed between the sub-pixel electrode 18*b* and a storage capacitor bus line CsL2. The storage capacitor bus line CsL1 is provided so as to extend in parallel to gate bus lines GL and so as to be separated from the above-mentioned gate bus line GL by a region of the sub-pixel sp1. The storage capacitor bus line CsL2 is provided so as to extend in parallel to the gate bus lines GL and so as to be separated from the above-mentioned gate bus line GL by a region of the sub-pixel sp2.

For each pixel P, (i) the storage capacitor bus line CsL1 serves also as a storage capacitor bus line CsL2 with which a storage capacitor 22*b* is formed by the sub-pixel sp2 of a pixel P that is adjacent to the pixel P across the storage capacitor bus line CsL1, and (ii) the storage capacitor bus line CsL2 serves also as a storage capacitor bus line CsL1 with which a storage capacitor 22*a* is formed by the sub-pixel sp1 of a pixel P that is adjacent to the pixel P across the storage capacitor bus line CsL2.

With reference to FIGS. 8 and 9, the following description deals with a method for driving the storage capacitor bus lines CsL1 and CsL2 included in a display panel which employs the multi-pixel driving method.

As illustrated in FIG. 8, the storage capacitor bus lines CsL (referring collectively to the storage capacitor bus lines CsL1 and CsL2) are (i) provided alternately in an active area AA, that is, a display region, and (ii) connected to CS trunk lines bb provided in regions adjacent to the active area AA. A plurality of the CS trunk lines bb form a CS trunk line group BB. The CS trunk lines bb are provided so that a single CS trunk line group BB is formed only in a first region (that is, only in one of the adjacent regions) which is adjacent to the active area AA on a predetermined side of a first direction in which the storage capacitor bus lines CsL extend. The predetermined side is a side on which a first end of each of the storage capacitor bus lines CsL is present. Alternatively, the CS trunk lines bb are provided so that a CS trunk line group BB is formed in each of (i) the first region and (ii) a second region (that is, in each of the adjacent regions) which is adjacent to the active area AA on a side of the first direction. The side is a side on which a second end of each of the storage capacitor bus lines CsL is present.

In the case where a single CS trunk line group BB is provided only in one of the adjacent regions, the first end, present on the predetermined side, of each of the storage capacitor bus lines CsL is connected to a CS trunk line bb. In the case where a CS trunk line group BB is provided in each of the adjacent regions, (i) the first end, present on the predetermined side, of each of the storage capacitor bus lines CsL is connected to a CS trunk line bb provided in the region which is adjacent to the active area AA on the side on which the first end is present, whereas (ii) the second end of each of the storage capacitor bus lines CsL is connected to a CS trunk line bb provided in the region which is adjacent to the active area AA on the side on which the second end is present. The CS trunk lines bb extend in a second direction orthogonal to the first direction in which the storage capacitor bus lines CsL1 and CsL2 extend, the second direction being a direction in which the source bus lines SL extend.

FIG. 8 illustrates an example case in which a CS trunk line group BB made up of 12 CS trunk lines bb is provided in each of the adjacent regions. The storage capacitor bus lines CsL are each connected to (i) a CS trunk line bb of one of the CS trunk line groups BB and (ii) a CS trunk line bb of the other of the CS trunk line groups BB. Specifically, 12 storage capacitor bus lines CsL (the number 12 being equal to the number n [where n is an even number] of CS trunk lines bb which make up each CS trunk line group BB) provided next to one another are connected to respective CS trunk lines bb of each of the CS trunk line groups BB. Each set of 12 (that is, n) storage capacitor bus lines are connected the CS trunk lines bb as such.

In the case where a single CS trunk line group BB is provided only in one of the adjacent regions, n storage capacitor bus lines CsL provided next to one another are connected to respective CS trunk lines bb of the CS trunk line group BB. Each set of n storage capacitor bus lines are connected to the CS trunk lines bb as such.

Both in the case where a single CS trunk line group BB is provided only in one of the adjacent regions and in the case where a CS trunk line group BB is provided in each of the adjacent regions, n storage capacitor bus lines CsL provided next to one another are supplied with respective storage capacitor voltages illustrated in FIG. 9. On each odd-numbered line, a pair of storage capacitor bus lines CsL1 and CsL2 corresponding to the sub-pixels sp1 and sp2 of a pixel P are supplied with storage capacitor voltages Vcs (indicated by Vcs1, Vcs2 . . . in FIG. 9) having respective binary waveforms which are switched in level at identical timing and which oscillate through an identical cycle period. Such pairs of storage capacitor voltages Vcs are provided in a number of n/2 such that the pairs have respective phases which are gradually shifted from one odd-numbered line to the next. Gate pulses Vg (indicated by Vg1, Vg3 . . . in FIG. 9) for the respective odd-numbered lines each have a pulse period which corresponds to a period of corresponding storage capacitor voltages Vcs during which period respective values of the corresponding storage capacitor voltages Vcs are constant. The pulse period ends at the rise or fall of each corresponding storage capacitor voltage Vcs.

With the above arrangement in use, data signals are first written to the pixels P on the odd-numbered lines. After the data signals are written, the storage capacitor voltages Vcs are changed. While an identical data signal is written to the two sub-pixels sp1 and sp2 of a pixel P, the above change causes different potential shift amounts ΔV to be added to the respective potentials of the pixel electrodes of the two sub-pixels sp1 and sp2. This is due to a feed-through phenomenon via a capacitance between the gate bus line GL and each pixel electrode. As a result of the above addition, the sub-pixels sp1 and sp2 are different from each other in luminance. As such, an average luminance corresponding to an effective voltage applied across the liquid crystal layer through one frame period of the storage capacitor voltages Vcs is suitable over a wide viewing angle in terms of a γ characteristic for the pixels P as a whole.

When the even-numbered lines are scanned after the odd-numbered lines are scanned, storage capacitor voltages Vcs applied to the sub-pixels sp1 and sp2 of each pixel P form a pair of voltages which are switched in level not at identical timing between the odd-numbered lines and the even-numbered lines. However, the pixel electrodes on the even-numbered lines each have a potential whose first change after the end of a corresponding gate pulse is similar to that for the odd-numbered lines. This also indicates an improved γ characteristic.

Note that the above description merely exemplifies the respective waveforms of the storage capacitor voltages Vcs and the manner of line scanning. A main feature of this technique is rather the following: The sub-pixels sp1 and sp2 of a pixel P are caused to be different from each other in luminance with use of changes in the respective storage capacitor voltages Vcs, the changes being different from one another, so that the γ characteristic of the pixels P as a whole is improved.

The storage capacitor voltages Vcs are each supplied to a storage capacitor bus line CsL via a corresponding CS trunk line bb. The CS trunk lines bb of each CS trunk line group BB are thus supplied with storage capacitor voltages Vcs which are different from one another. It follows that a CS driver (not shown) supplies, to each CS trunk line group BB, a number of storage capacitor voltages Vcs having respective phases different from one another, the number being equal to the number of the CS trunk lines bb in the CS trunk line group BB. FIG. 9 illustrates an example case in which storage capacitor voltages Vcs having 12 phases are supplied (the first 10 phases of the storage capacitor voltages Vcs 1-Vcs10 being illustrated). Further, in the case where a CS trunk line group BB is provided in each of the regions adjacent to the active area AA as illustrated in FIG. 8, an identical storage capacitor voltage Vcs is applied to two CS trunk lines bb each included in one of the CS trunk line groups BB, the two CS trunk lines bb being connected to an identical storage capacitor bus line CsL. In the case where a storage capacitor voltage Vcs is, as described above, supplied from both of the regions adjacent to the active area AA, it is possible to prevent, on a large liquid crystal display screen, such a storage capacitor voltage Vcs from having a waveform which is different depending on a location in the active area AA due to an interconnect delay.

CITATION LIST

Patent Literature 1

Japanese Patent Application Publication N 2004-62146 A (Publication Date: Feb. 26, 2004)

Patent Literature 2

Japanese Patent Application Publication No. 2005-156661 A (Publication Date: Jun. 16, 2005)

Patent Literature 3

PCT International Publication WO2005/073953 Pamphlet (Publication Date: Aug. 11, 2005)

Patent Literature 4

Japanese Patent Application Publication No. 2002-236474 A (Publication Date: Aug. 23, 2002)

SUMMARY OF INVENTION

Technical Problem

A liquid crystal display device which employs the multi-pixel driving method and which includes conventional CS trunk lines bb has a CS trunk line group BB made up of a plurality of CS trunk lines bb. Such a liquid crystal display device has a distance d between the active area AA and each CS trunk line bb which distance d is different depending on the CS trunk line bb as illustrated in FIG. 10. Further, the CS trunk lines bb and the storage capacitor bus lines CsL are formed of respective metal layers which are different from each other. For example, the CS trunk lines bb are made of a source metal, whereas the storage capacitor bus lines CsL are made of a gate metal. The storage capacitor bus lines CsL, which cross each of the CS trunk line groups BB via a dielectric layer, are thus each connected to a corresponding CS trunk line bb of each CS trunk line group BB via a contact hole 150 provided in the dielectric layer.

A storage capacitor bus line CsL connected to a CS trunk line bb located farther from the active area AA has a longer feed section F, that is, a larger distance d from the active area AA to the location (that is, a contact hole 150) at which the storage capacitor bus line CsL is connected to the CS trunk line bb. Such a storage capacitor bus line CsL thus has a larger interconnect resistance accordingly. While the CS trunk lines are provided in a small number of 12 in each CS trunk line group BB, the storage capacitor bus lines CsL are provided in an extremely large number on the order of thousands, for example. The storage capacitor bus lines CsL thus need to have a line width which is significantly smaller than that of the CS trunk lines bb.

The storage capacitor voltages Vcs applied to the respective storage capacitor bus lines CsL are each changed by an influence of a potential of each corresponding pixel electrode. Thus, the above difference in length among the feed sections F results in a difference, among the storage capacitor bus lines CsL, in attenuation of ripple voltages of the respective storage capacitor voltages Vcs changed as above, the attenuation being observed at portions of each storage capacitor bus line CsL which portions correspond to respective edges of the active area AA. FIG. 11 illustrates the difference in attenuation of the ripple voltages. FIG. 11 illustrates, with a solid line, a waveform 101 of a storage capacitor bus line CsL having a feed section F connected to a CS trunk line bb located far from the active area AA (that is, a storage capacitor bus line CsL having a feed section F which is large in distance d from the active area AA to a CS trunk line bb to which the storage capacitor bus line CsL is connected). The waveform 101 is observed at an edge of the active area AA which edge is present on a side on which the feed section F is present. FIG. 11 further illustrates, with a dashed line, a waveform 102 of a storage capacitor bus line CsL having a feed section F connected to a CS trunk line bb located closely to the active area AA (that is, a storage capacitor bus line CsL having a feed section F which is small in distance d from the active area AA to a CS trunk line bb to which the storage capacitor bus line CsL is connected). The waveform 102 is observed at the edge of the active area AA which edge is present on the side on which the feed section F is present. The waveform 101 indicates a ripple voltage larger than a ripple voltage indicated by the waveform 102.

If there is such a difference in magnitude of ripple voltages of the respective storage capacitor voltages Vcs among the storage capacitor bus lines CsL, the ripple voltages at the edges of the active area AA have a distribution in accordance with respective locations of the storage capacitor bus lines CsL as illustrated in FIG. 8. Because of this distribution, there occurs distribution in luminance of sub-pixels sp1 and sp2 (that is, of pixels P) present near the edges of the active area AA. This has conventionally caused a first problem of, for example, lateral streaks visible on the screen.

In a case where a DC voltage is constantly applied across a liquid crystal layer for an extended period of time in a liquid crystal display device, pixels are impaired. It is thus necessary to carry out AC driving (inversion driving), in which a polarity of each applied voltage is periodically reversed, so as to achieve a longer life. However, in a case where an active matrix liquid crystal display device employs a frame inversion driving method, in which inversion is carried out every frame, there inevitably occurs at least a slight imbalance between positive and negative voltages, applied across the liquid crystal layer, due to various factors such as (i) a dielectric anisotropy of the liquid crystal, (ii) fluctuations in pixel potential which arise from a parasitic capacitance between a gate and a source of a pixel TFT, and (iii) a shift in center value of a counter electrode signal. As such, there is a problem that slight fluctuations in luminance occur with a frequency component of half a frame frequency, and a flicker is thus visible. In view of prevention of this problem, not only the above inversion driving method, in which inversion is carried out every frame, but also another inversion driving method is generally employed, that is, an inversion driving method in which each pixel signal has a polarity that is reversed from one line to the next or from one pixel to the next.

In a case where dot inversion is carried out, in which the polarity is reversed for each pixel, each data signal line is recharged with a data signal having a polarity which is different for each horizontal period. This causes a problem that a charging rate for pixels is decreased due to a signal delay on the data signal line. In view of prevention of this problem, a technique has been proposed which reverses the polarity of each data signal voltage for each plurality of horizontal periods (that is, for each plurality of lines). This driving method of reversing the polarity of each data signal voltage for each plurality of horizontal periods is referred to as "block inversion driving."

FIG. 12 illustrates an example of how CS trunk lines bb are connected to storage capacitor bus lines CsL in a case where a liquid crystal display device which employs the multi-pixel driving method carries out block inversion driving at double frame rate. FIG. 13 illustrates respective driving waveforms for the CS trunk lines bb.

FIG. 12 illustrates only a CS trunk line group BB provided in one of the regions adjacent to the active area AA. In the case where an additional CS trunk line group BB is provided in the other of the adjacent regions, this additional CS trunk line group BB will have a configuration identical to that of the CS trunk line group BB illustrated in FIG. 12. This example includes 12 CS trunk lines bb1 through bb12 (each indicated by its bb index number in FIG. 12). This example further includes pixels PIX aligned in a column direction in an order of PIX1, PIX2, PIX3 . . . (each indicated by its PIX index number in FIG. 12). The pixels form columns of R, G, and B. The pixels are each connected to two storage capacitor bus lines CsL. Specifically, the sub-pixels sp of each pixel are connected to the two respective storage capacitor bus lines CsL. Each of the pixels PIX has a first sub-pixel sp which borders a second sub-pixel sp of a pixel PIX which is adjacent to the above pixel PIX, and the first and second sub-pixels sp share an identical storage capacitor bus line CsL. FIG. 12 illustrates, for each of R, G, and B, the sub-pixels sp which are sequentially connected to the CS trunk lines bb. Specifically, the sub-pixel spa1 of each pixel PIX1 is connected to the CS trunk line bb1, and the sub-pixel spb1 of each pixel PIX1 and the sub-pixel spa2 of each pixel PIX2 are connected to the CS trunk line bb2.

The sub-pixels spa of the respective pixels PIX25 to PIX48 are connected to the CS trunk lines bb to which the sub-pixels spb of the respective pixels PIX1 to PIX24 are connected, whereas the sub-pixels spb of the respective pixels PIX25 to PIX48 are connected to the CS trunk lines bb to which the sub-pixels spa of the respective pixels PIX1 to PIX24 are connected. These 48 pixels PIX form a unit, which is repeatedly provided in a screen scanning direction. The number of the units provided is, for example, 22 in a case where there are 1080 scan lines. The 22 units form a pattern, to which a connection pattern corresponding to the pixels PIX1 to PIX24 is added to complete an entire pattern. Note that there are provided, one pixel upstream of the pixel PIX1 in the scanning direction, a dummy pixel PIX0 including (i) a sub-pixel spa0 connected to the CS trunk line bb11 and (ii) a sub-pixel spb0 sharing a storage capacitor bus line CsL with the sub-pixels spa1. This allows the 48 pixels PIX of a topmost unit to have borders which are under the same conditions as those of other units. There are additionally provided, one pixel downstream of, for example, bottommost pixels PIX 1080 in the scanning direction, dummy pixels PIX1081 (not shown) including (i) respective sub-pixels spa1081 sharing a storage capacitor bus line CsL with the sub-pixels spb1080 and (ii) respective sub-pixels spb1081 connected to the CS trunk line bb1. This allows the 48 pixels PIX of a bottommost unit to have borders which are under the same conditions as those of other units.

With use of the arrangement illustrated in FIG. 12, block inversion driving is carried out, for example, as follows: First, even-numbered rows on which the respective pixels PIX2, PIX4 . . . , and PIX48 are provided are sequentially scanned so that these pixels are supplied with respective positive data signals. Second, odd-numbered rows on which the respective pixels PIX1, PIX3 . . . PIX49 . . . , and PIX95 are provided are sequentially scanned so that these pixels are supplied with respective negative data signals. Third, even-numbered rows on which the respective pixels PIX50, PIX52 . . . PIX96 . . . , and PIX144 are provided are sequentially scanned so that these pixels are supplied with respective positive data signals. As described above, data signals sharing an identical polarity are first written to respective pixels of a first block including 24 rows present every other row. For subsequent blocks, data signals sharing an identical polarity which is opposite to a polarity of data signals written to respective pixels of a preceding block are written to respective pixels of each following block including 48 rows present every other row, while rows to which the data signals are written first are switched between even-numbered rows and odd-numbered rows from one block to the next. After data signals are written to respective pixels of a last block including bottommost 24 rows present every other row for a current frame, data signals sharing an identical polarity are written to the respective pixels of the first block including the first 24 rows present every other row. These data signals thus written to the respective pixels of the first block including the first 24 rows present every other row share a polarity which is opposite to the polarity of the data signals written to the same respective pixels during the previous frame. As such, data signals written to the respective pixels of each block have a polarity which is reversed every frame.

The storage capacitor voltages applied to the respective CS trunk lines bb during the above operation include six pairs of driving signals (having 12 different phases in total) each of which pairs is made up of two driving signals having respective binary-level waveforms which are opposite to each other in phase (see FIG. 13). In this example, each driving signal pair is made up of two driving signals for respective CS trunk lines bb adjacent to each other. The pair of driving signals CS1 and CS2 through the pair of driving signals CS11 and CS12 correspond to a pair of CS trunk lines bb1 and bb2 through a pair of CS trunk lines bb11 and bb12, respectively. In FIG. 13, numbers shown horizontally so as to correspond to a period other than a vertical blanking period VB each (i) indicate the number of a row to which data signals are supplied and thus (ii) correspond to one horizontal period. The vertical blanking period VB is set as a period equivalent to, for example, eight horizontal periods of periods 1' through 8' (that is, equivalent to eight clocks). Further, each of the driving signals is assigned to a single CS trunk line bb. The driving signal pairs are also shifted in phase from one another. In the example of FIG. 13, the pair of driving signals CS1 and CS2 through the pair of driving signals CS11 and CS12 are shifted in phase from one another so that the pairs are lagged from one pair to the next, in the above order, each by two horizontal periods.

Each of the driving signals alternately repeats (i) a high-level period, during which the driving signal constantly has a high level, and (ii) a low-level period, during which the driving signal constantly has a low level. The high-level period and the low-level period are each designated as one cyclic term. A middle of the high level and the low level corresponds to a common voltage. The high-level periods and the low-level periods of any given driving signal are switched with each other every frame. In AC driving, a data signal line tends to have a poor charging rate for a data signal having a newly switched polarity. Thus, in this example, a dummy horizontal period (indicated by DH1 in FIG. 13) is set immediately after the polarity of data signals is switched. The dummy horizontal period DH1 is an additional period set so that a data signal which is supplied first immediately after the polarity of data signals is switched can sufficiently charge a data signal line. The dummy horizontal period DH1 is thus set before a selection period during which a pixel PIX to which the data signal supplied first immediately after the polarity of data signals is switched is written. For example, in FIG. 13, two horizontal periods during each of which no selection signal is outputted are provided before the selection period during which the PIX1 receives a data signal.

The dummy horizontal period needs to be provided at every timing at which the polarity of data signals is switched. The polarity is last reversed in a frame in a direction (that is, either from positive to negative or from negative to positive) identical to a direction in which the polarity is first reversed in the frame. As such, during one frame period, one polarity is maintained for a period longer than a period for which the other polarity is maintained. In addition, since each storage capacitor bus line CSL is supplied with a driving signal which is reversed in polarity every frame, such a driving signal for the storage capacitor bus line CSL has, for a cycle term during which the dummy horizontal period is set, a level which is switched every frame. It follows that with this arrangement, effective voltages which are applied across the liquid crystal layer in respective frames when the storage capacitor bus lines CSL are driven are not equal between positive and negative polarities.

Thus, while data signals of either polarity are outputted, each storage capacitor bus line CSL is supplied with a driving signal that has a period including an extended period which corresponds in length to the dummy horizontal period and during which the driving signal has a level with a polarity opposite to the polarity for the dummy horizontal period. This equalizes the effective voltages between positive and negative polarities. Accordingly, the example of FIG. 13 sets another dummy horizontal period indicated by DH73. In addition, a first polarity period and a last polarity period in a frame are (i) each a period during which signals are written for 24 rows, and (ii) opposite to each other in polarity. For each of the first and last polarity periods, a second dummy horizontal period in addition to a first dummy horizontal period is set during which second dummy horizontal period the driving signal has a level with a polarity opposite to a polarity for the first dummy horizontal period. FIG. 13 thus illustrates, for the first polarity period, a first dummy horizontal period DH26 and a second dummy horizontal period DH2. Further, in this example, a last polarity period also has periods (not shown) similar to the first and second dummy horizontal periods of the first polarity period.

FIG. 13 illustrates ellipses each indicating a combination of driving signals for respective storage capacitor bus lines CSL which driving signals are supplied to an identical pixel PIX on a row when a data signal is written to the pixel PIX. Each horizontal period corresponds to either (i) a single ellipse covering such a combination of driving signals or (ii) two ellipses each covering one of such driving signals.

As described above, during a cyclic term during which the dummy horizontal period is set, data signals are written to, for example, the pixels PIX24 and PIX48 before the dummy horizontal period. The pixels PIX24 and PIX48 are supplied with a driving signal CS2 and a driving signal CS1, respectively. The driving signals CS2 and CS1 thus supplied are each a driving signal which is used eight horizontal periods after an immediately previous level inversion. The driving signals CS2 and CS1 are thus each a driving signal which is used a period after an immediately previous level inversion which period is shorter than corresponding periods for other pixels PIX. The pixel PIX28, for example, is supplied with a driving signal CS4, which is a driving signal that is used 10 horizontal periods after an immediately previous level inversion.

Thus, when a data signal is written to a pixel such as the pixels PIX24 and PIX48, a period during which the pixel electrode potential is affected by the driving signal implementing the inversion of the storage capacitor voltage is discontinuously different from a period for any of pixels PIX on other rows through respective horizontal periods, during which data signals are written to pixels which follow the pixel such as the pixels PIX24 and PIX48, within a given cyclic term during which (i) one of the driving signals CS1, CS3 . . . , and CS11 has a high-level period and (ii) a corresponding one of the driving signals CS2, CS4 . . . , and CS12 has a low-level period. As such, an effective voltage applied across the liquid crystal layer by driving storage capacitor voltages is different from those for other pixels PIX. In addition, the storage capacitor bus line CSL has a charging rate which is smaller than those of storage capacitor bus lines CSL on which other pixels PIX are provided. This widens the difference in effective voltage. As a result, pixels PIX on a row for which data signals are written during such a unique horizontal period as described above within the above given cyclic term are different in luminance from pixels PIX on other rows. This causes a problem that even in a case where a uniform gray display is carried out, a streak pattern as illustrated in FIG. 14 becomes visible.

The present invention has been accomplished in view of the above conventional problem. It is an object of the present invention to provide (i) a display device in which storage capacitor bus lines are driven by a plurality of driving signals having phases different from one another, and in which a streak pattern is prevented from appearing even if data signals are written to pixels during a unique horizontal period, (ii) a display device driving method, and (iii) a display driving control method.

Solution to Problem

In order to solve the above problem, a display device of the present invention is a display device in which: a plurality of storage capacitor bus lines are driven by respective driving signals that (i) have a predetermined number of phases forming pairs which are shifted from one another and each of which is made up of two phases opposite to each other, (ii) each have a binary level in potential during a pixel selection period, and (iii) are reversed in level every frame period; and data signals which are written to respective pixels each have a polarity that (i) is reversed every frame, and (ii) is reversed in such a manner as to remain identical for each plurality of horizontal periods within each frame, the display device including: correcting means for, in a case where a first data signal is to be written to a first pixel during a unique horizontal period, (i) carrying out a first gray scale correction with respect to display data corresponding to the first data signal to be written to the first pixel during the unique horizontal period, and (ii) supplying the display data to a display driver, the unique horizontal period being a first horizontal period for one of the driving signals which first horizontal period occurs, in a case where a cyclic term corresponds to a period during which either of a high level and a low level included in the binary level of each of the driving signals is retained, a first number of horizontal periods after an initial horizontal period included in a given cyclic term for either or both of (i) the high level and (ii) the low level included in the binary level, the given cyclic term being a second cyclic term for the driving signals which second cyclic term occurs a second number of cyclic terms after a first cyclic term including a horizontal period during which the data signals start to be written to the pixels, the first number being different from a corresponding number for any other of the driving signals.

According to the above arrangement of the present invention, by causing the correcting means to carry out the gray scale correction with respect to display data, it is possible to carry out a gray scale correction with respect to display data corresponding to a data signal which is written to a pixel during a unique horizontal period. As such, an effective voltage applied to liquid crystal for the pixel to which a data signal is written during the unique horizontal period within a given cyclic term, set for each of the driving signals supplied to the respective storage capacitor bus lines, can be made substantially equal to those for other pixels to which respective data signals are written during the given cyclic term. It follows that in a case where a uniform gray display is carried out on the display panel, it is possible to make luminances of all pixels substantially equal to one another.

As such, it is possible to provide a display device in which (i) storage capacitor bus lines are driven by driving signals having a plurality of phases, and (ii) a streak pattern is thus prevented in a case where data signals are written to the pixels during the unique horizontal period.

In order to solve the above problem, the display device of the present invention may be arranged such that the pixels each include a plurality of sub-pixels; and the sub-pixels of each of the pixels form respective storage capacitors with different ones of the storage capacitor bus lines.

The above arrangement of the present invention (i) eliminates the streak pattern and thus (ii) accurately improves, over a wide viewing angle, a gray scale reversal phenomenon involving the use of the plurality of sub-pixels.

In order to solve the above problem, the display device of the present invention may be arranged such that the first data signal is written to the first pixel during the unique horizontal period as the first horizontal period which occurs the first number of horizontal periods after the initial horizontal period included in the given cycle period, the first number being different from the corresponding number for any other of the driving signals by providing, before a subsequent horizontal period during which a subsequent one of the data signals is written, a dummy horizontal period during which no data signal is written to a pixel.

According to the above arrangement of the present invention, it is possible to (i) sufficiently secure, with use of the dummy horizontal period, a charging rate of a data signal line for a data signal having a reversed polarity, and thus (ii) eliminate the streak pattern.

In order to solve the above problem, the display device of the present invention may be arranged such that the correcting means carries out the first gray scale correction with respect to display data on a basis of an input gray scale of the display data supplied to the correcting means.

According to the above arrangement of the present invention, it is possible to (i) make a particularly great correction to the basis of the input gray scale by which the streak pattern is highly likely to be visible, and thus (ii) particularly preferably eliminate the streak pattern.

In order to solve the above problem, the display device of the present invention may be arranged such that the correcting means carries out the gray scale correction with respect to display data, corresponding to a second data signal, in accordance with a row position on a display panel, of a second pixel to which the second data signal is to be written.

According to the above arrangement of the present invention, a gray scale correction can be carried out depending on the distance between the active area and the position at which each storage capacitor bus line is connected to a corresponding trunk lines. As such, it is possible to eliminate the gradation in the column direction.

In order to solve the above problem, the display device of the present invention may be arranged such that the correcting means further carries out the second gray scale correction with respect to the display data, corresponding to the second data signal, in accordance with a column position on the display panel, of the second pixel.

According to the above arrangement of the present invention, it is possible to eliminate a gradation appearing on an identical row, depending on the distance from each position on the display panel to a corresponding CS trunk line.

In order to solve the above problem, a method of the present invention for driving a display device includes the steps of: driving a plurality of storage capacitor bus lines by respective driving signals that (i) have a predetermined number of phases forming pairs which are shifted from one another and each of which is made up of two phases opposite to each other, and (ii) each have a binary level in potential during a pixel selection period, and reversing the driving signals in level every frame period; and reversing polarity of each of data signals every frame which are written to respective pixels, and reversing the polarity in such a manner that the polarity remains identical for each plurality of horizontal periods within each frame, the method further including the step of: carrying out, in a case where a first data signal is to be written to a first pixel during a unique horizontal period, a first gray scale correction with respect to display data corresponding to the first data signal to be written to the first pixel during the unique horizontal period, and (ii) supplying the display data to a display driver, the unique horizontal period being a first horizontal period for one of the driving signals which first horizontal period occurs, in a case where a cyclic term corresponds to a period during which either of a high level and a low level included in the binary level of each of the driving signals is retained, a first number of horizontal periods after an initial horizontal period included in a given cyclic term for either or both of (i) the high level and (ii) the low level included in the binary level, the given cyclic term being a second cyclic term for the driving signals which second cyclic term occurs a second number of cyclic terms after a first cyclic term including a horizontal period during which the data signals start to be written to the pixels, the first number being different from a corresponding number for any other of the driving signals.

According to the above arrangement of the present invention, by carrying out the gray scale correction with respect to display data, it is possible to carry out a gray scale correction with respect to display data corresponding to a data signal which is written to a pixel during a unique horizontal period. As such, an effective voltage applied to liquid crystal for the pixel to which a data signal is written during the unique horizontal period within a given cyclic term, set for each of the driving signals supplied to the respective storage capacitor bus lines, can be made substantially equal to those for other pixels to which respective data signals are written during the given cyclic term. It follows that in a case where a uniform gray display is carried out on the display panel, it is possible to make luminances of all pixels substantially equal to one another.

As such, it is possible to provide a method for driving a display device in which method (i) storage capacitor bus lines are driven by driving signals having a plurality of phases, and (ii) a streak pattern is thus prevented in a case where data signals are written to the pixels during the unique horizontal period.

In order to solve the above problem, the method of the present invention for driving a display device may be arranged such that the pixels each include a plurality of sub-pixels; and the sub-pixels of each of the pixels form respective storage capacitors with different ones of the storage capacitor bus lines.

The above arrangement of the present invention (i) eliminates the streak pattern and thus (ii) accurately improves, over a wide viewing angle, a gray scale reversal phenomenon involving the use of the plurality of sub-pixels.

In order to solve the above problem, the method of the present invention for driving a display device may be arranged such that the first data signal is written to the first pixel during the unique horizontal period as the first horizontal period which occurs the first number of horizontal periods after the initial horizontal period included in the given cycle period, the first number being different from the corresponding number for any other of the driving signals by providing, before a subsequent horizontal period during which a subsequent one of the data signals is written, a dummy horizontal period during which no data signal is written to a pixel.

According to the above arrangement of the present invention, it is possible to (i) sufficiently secure, with use of the dummy horizontal period, a charging rate of a data signal line for a data signal having a reversed polarity, and thus (ii) eliminate the streak pattern.

In order to solve the above problem, the method of the present invention for driving a display device may be arranged such that the first gray scale correction is carried out with respect to display data on a basis of an input gray scale of the display data supplied.

According to the above arrangement of the present invention, it is possible to (i) make a particularly great correction to the basis of the input gray scale by which the streak pattern is highly likely to be visible, and thus (ii) particularly preferably eliminate the streak pattern.

In order to solve the above problem, the method of the present invention for driving a display device may be arranged such that a second gray scale correction is carried out with respect to display data, corresponding to a second data signal, in accordance with a row position on a display panel, of a second pixel to which the second data signal is to be written.

According to the above arrangement of the present invention, a gray scale correction can be carried out depending on the distance between the active area and the position at which each storage capacitor bus line is connected to a corresponding trunk lines. As such, it is possible to eliminate the gradation in the column direction.

In order to solve the above problem, the method of the present invention for driving a display device may be arranged such that the second gray scale correction is further carried out with respect to the display data, corresponding to the second data signal, in accordance with a column position on the display panel, of the second pixel.

According to the above arrangement of the present invention, it is possible to eliminate a gradation appearing on an identical row, depending on the distance from each position on the display panel to a corresponding CS trunk line.

In order to solve the above problem, a method of the present invention for controlling display driving of a display device in which: a plurality of storage capacitor bus lines are driven by respective driving signals that (i) have a predetermined number of phases forming pairs which are shifted from one another and each of which is made up of two phases opposite to each other, (ii) each have a binary level in potential during a pixel selection period, and (iii) are reversed in level every frame period; and data signals which are written to respective pixels each have a polarity that (i) is reversed every frame, and (ii) is reversed in such a manner as to remain identical for each plurality of horizontal periods within each frame, the display device including: correcting means for, in a case where a first data signal is to be written to a first pixel during a unique horizontal period, (i) carrying out a first gray scale correction with respect to display data corresponding to the first data signal to be written to the first pixel during the unique horizontal period, and (ii) supplying the display data to a display driver, the unique horizontal period being a first horizontal period for one of the driving signals which first horizontal period occurs, in a case where a cyclic term corresponds to a period during which either of a high level and a low level included in the binary level of each of the driving signals is retained, a first number of horizontal periods after an initial horizontal period included in a given cyclic term for either or both of (i) the high level and (ii) the low level included in the binary level, the given cyclic term being a second cyclic term for the driving signals which second cyclic term occurs a second number of cyclic terms after a first cyclic term including a horizontal period during which the data signals start to be written to the pixels, the first number being different from a corresponding number for any other of the driving signals.

According to the above arrangement of the present invention, by carrying out the gray scale correction with respect to display data, it is possible to carry out a gray scale correction with respect to display data corresponding to a data signal which is written to a pixel during a unique horizontal period. As such, an effective voltage applied to liquid crystal for the pixel to which a data signal is written during the unique horizontal period within a given cyclic term, set for each of the driving signals supplied to the respective storage capacitor bus lines, can be made substantially equal to those for other pixels to which respective data signals are written during the given cyclic term. It follows that in a case where a uniform gray display is carried out on the display panel, it is possible to make luminances of all pixels substantially equal to one another.

As such, it is possible to provide a method for controlling display driving in which method (i) storage capacitor bus lines are driven by driving signals having a plurality of phases, and (ii) a streak pattern is thus prevented in a case where data signals are written to the pixels during the unique horizontal period.

The method for controlling display driving may be arranged such that the first data signal is written to the first pixel during the unique horizontal period as the first horizontal period which occurs the first number of horizontal periods after the initial horizontal period included in the given cycle period, the first number being different from the corresponding number for any other of the driving signals by providing, before a subsequent horizontal period during which a subsequent one of the data signals is written, a dummy horizontal period during which no data signal is written to a pixel.

According to the above arrangement of the present invention, it is possible to (i) sufficiently secure, with use of the dummy horizontal period, a charging rate of a data signal line for a data signal having a reversed polarity, and thus (ii) eliminate the streak pattern.

The method of the present invention for controlling display driving may be arranged such that the first gray scale correction is carried out with respect to display data on a basis of an input gray scale of the display data supplied.

According to the above arrangement of the present invention, it is possible to (i) make a particularly great correction to the basis of the input gray scale by which the streak pattern is highly likely to be visible, and thus (ii) particularly preferably eliminate the streak pattern.

The method of the present invention for controlling display driving may be arranged such that a second gray scale correction is carried out with respect to display data, corresponding to a second data signal, in accordance with a row position on a display panel, of a second pixel to which the second data signal is to be written.

According to the above arrangement of the present invention, a gray scale correction can be carried out depending on the distance between the active area and the position at which each storage capacitor bus line is connected to a corresponding trunk lines. As such, it is possible to eliminate the gradation in the column direction.

The method of the present invention for controlling display driving may be arranged such that the second gray scale correction is further carried out with respect to the display data, corresponding to the second data signal, in accordance with a column position on the display panel, of the second pixel.

According to the above arrangement of the present invention, it is possible to eliminate a gradation appearing on an identical row, depending on the distance from each position on the display panel to a corresponding CS trunk line.

Advantageous Effects of Invention

As described above, a display device of the present invention is a display device in which: a plurality of storage capacitor bus lines are driven by respective driving signals that (i) have a predetermined number of phases forming pairs which are shifted from one another and each of which is made up of two phases opposite to each other, (ii) each have a binary level in potential during a pixel selection period, and (iii) are reversed in level every frame period; and data signals which are written to respective pixels each have a polarity that (i) is reversed every frame, and (ii) is reversed in such a manner as to remain identical for each plurality of horizontal periods within each frame, the display device including: correcting means for, in a case where a first data signal is to be written to a first pixel during a unique horizontal period, (i) carrying out a first gray scale correction with respect to display data corresponding to the first data signal to be written to the first pixel during the unique horizontal period, and (ii) supplying the display data to a display driver, the unique horizontal period being a first horizontal period for one of the driving signals which first horizontal period occurs, in a case where a cyclic term corresponds to a period during which either of a high level and a low level included in the binary level of each of the driving signals is retained, a first number of horizontal periods after an initial horizontal period included in a given cyclic term for either or both of (i) the high level and (ii) the low level included in the binary level, the given cyclic term being a second cyclic term for the driving signals which second cyclic term occurs a second number of cyclic terms after a first cyclic term including a horizontal period during which the data signals start to be written to the pixels, the first number being different from a corresponding number for any other of the driving signals.

As such, it is possible to provide a display device in which (i) storage capacitor bus lines are driven by driving signals having a plurality of phases, and (ii) a streak pattern is thus prevented in a case where data signals are written to the pixels during the unique horizontal period.

BRIEF DESCRIPTION OF DRAWINGS

FIG. 1 is a block diagram illustrating a configuration of correcting means in accordance with an embodiment of the present invention.

FIG. 2 is a block diagram illustrating a configuration of a timing controller included in a display control board together with the correcting means of FIG. 1.

FIG. 3 is a block diagram illustrating a configuration of a display device in accordance with the embodiment of the present invention.

FIG. 4 is a table for a description of a correction of an input gray scale carried out by the correcting means of FIG. 1.

FIG. 5 is a plan view for a description of a gradation appearing on a display panel, in accordance with the embodiment of the present invention.

FIG. 6

FIG. 6 illustrates charts for a description of the correction of an input gray scale for elimination of the gradation of FIG. 5, where (a) shows correction values according to row positions of pixels, and (b) shows correction values according to column positions of pixels.

FIG. 7 is a circuit diagram illustrating a configuration of a pixel involved in a multi-pixel driving method according to a conventional technique.

FIG. 8 is a plan view illustrating how storage capacitor bus lines and CS trunk lines are positioned according to a conventional technique.

FIG. 9 is a waveform chart illustrating example waveforms of storage capacitor voltages supplied to pixels included in the configuration of FIG. 8.

FIG. 10 is a plan view illustrating how the storage capacitor bus lines and the CS trunk lines are configured.

FIG. 11 is a waveform chart illustrating respective waveforms of ripple voltages of storage capacitor voltages illustrated in FIG. 9.

FIG. 12 is a connection diagram illustrating how the CS trunk lines are connected to the storage capacitor bus lines in block inversion driving of the multi-pixel driving method, in accordance with the conventional technique.

FIG. 13 is a timing chart illustrating respective waveforms of driving signals for the storage capacitor bus lines having the connection illustrated in FIG. 12.

FIG. 14 is a plan view for a description of a streak pattern which becomes visible on a display panel in response to the driving illustrated in FIG. 13.

DESCRIPTION OF EMBODIMENTS

An embodiment of the present invention is described below with reference to FIGS. 1 through 6.

Figure 3:
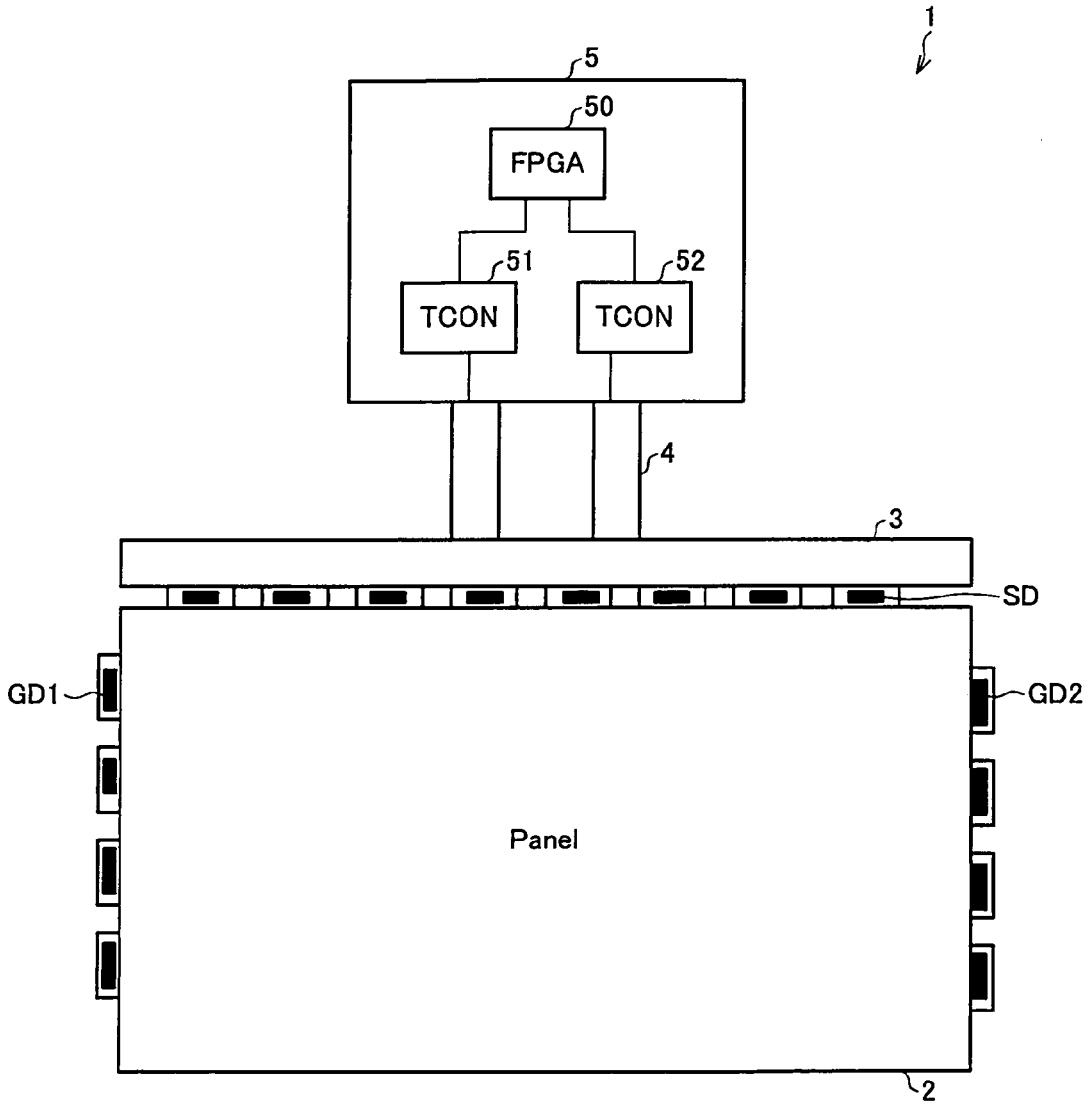
FIG. 3

FIG. 3 illustrates a configuration of a liquid crystal display device (display device) 1 of the present embodiment. As illustrated in FIG. 3, the liquid crystal display device 1 includes: a display panel 2; a SOF board 3; a plurality of source drivers (display drivers) SD; a plurality of gate drivers GD1 and GD2; flexible wirings 4; and a display control board 5. Note that these components can be arranged in any manner. For example, the display panel 2 can be integrated with any other component on a single panel. Alternatively, the source drivers SD, the gate drivers GD1 and GD2, and the display control board 5 can be either partially or entirely mounted on a single external board, such as a flexible printed circuit board, which is connected to a panel on which the display panel 2 is provided.

Figure 10:
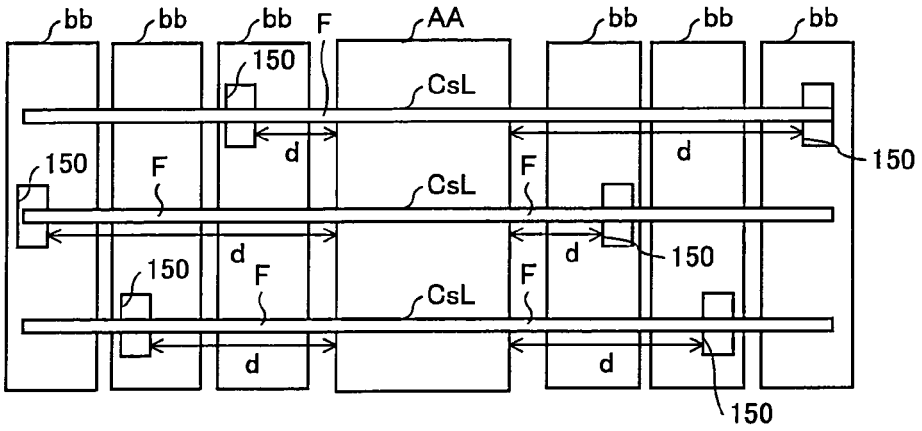
FIG. 10
Figure 11:
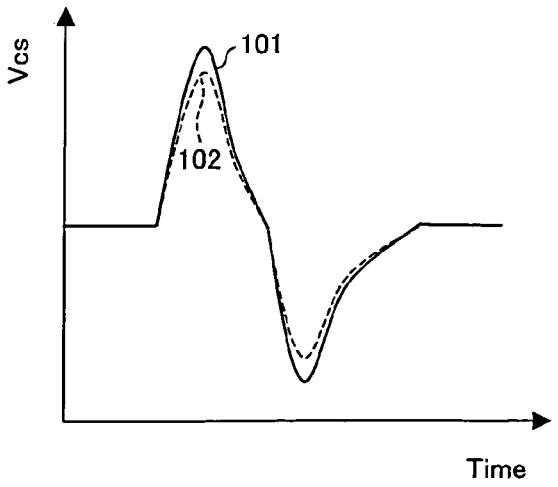
FIG. 11
Figure 12:
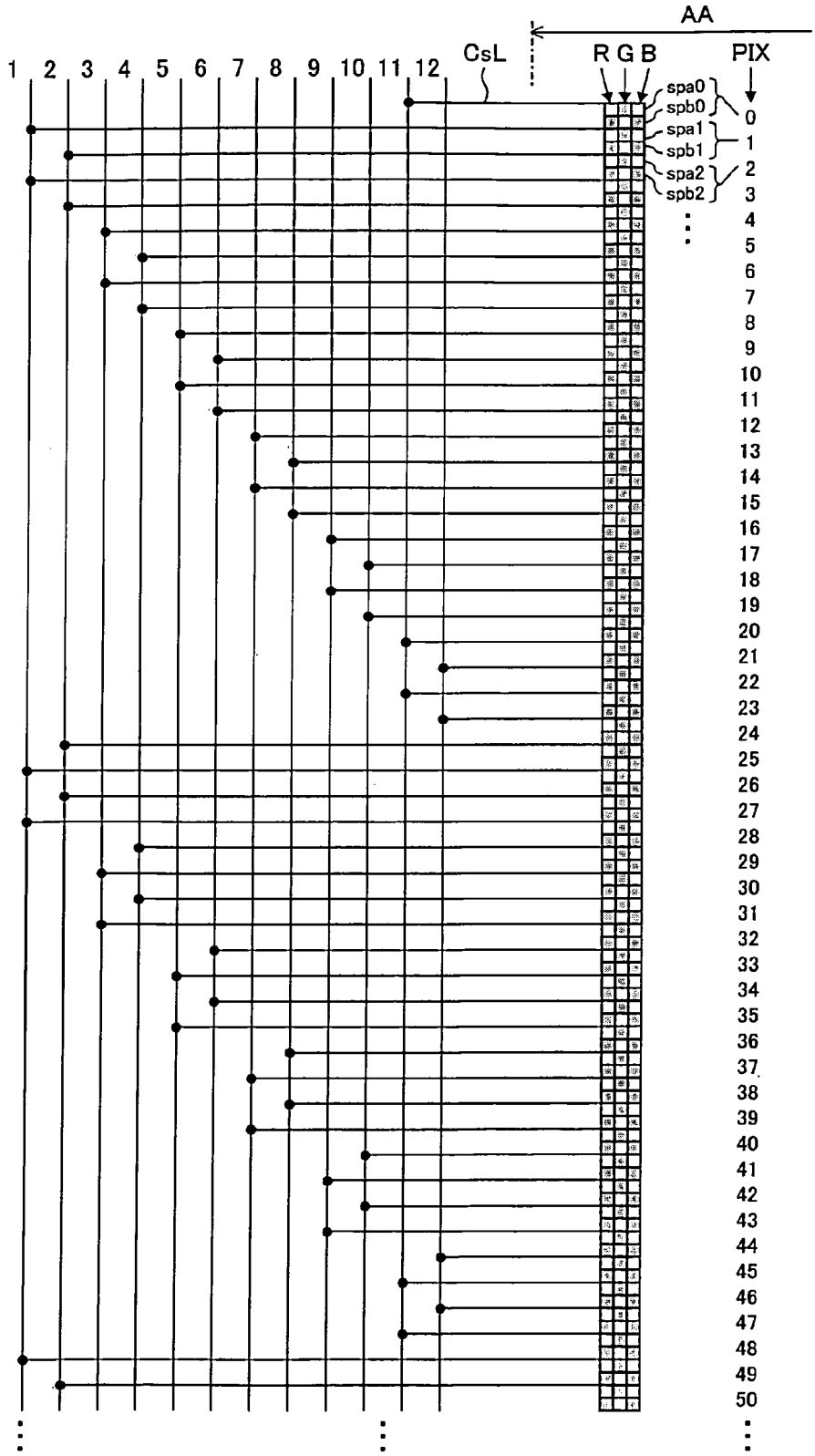
FIG. 12

The display panel 2 includes the following members described above with reference to FIGS. 7, 8, and 10: pixels P each of which is made up of sub-pixels sp1 and sp2 and which are arranged in a matrix pattern in an active area AA; a plurality of gate bus lines GL; a plurality of source bus lines SL; a plurality of storage capacitor bus lines CsL1 and CsL2; and two CS trunk line groups BB and BB. The CS trunk line groups BB and BB are each configured and connected to the storage capacitor bus lines CsL as illustrated in FIG. 12. The CS trunk line groups BB and BB each exhibit driving waveforms illustrated in FIG. 13.

Figure 7:
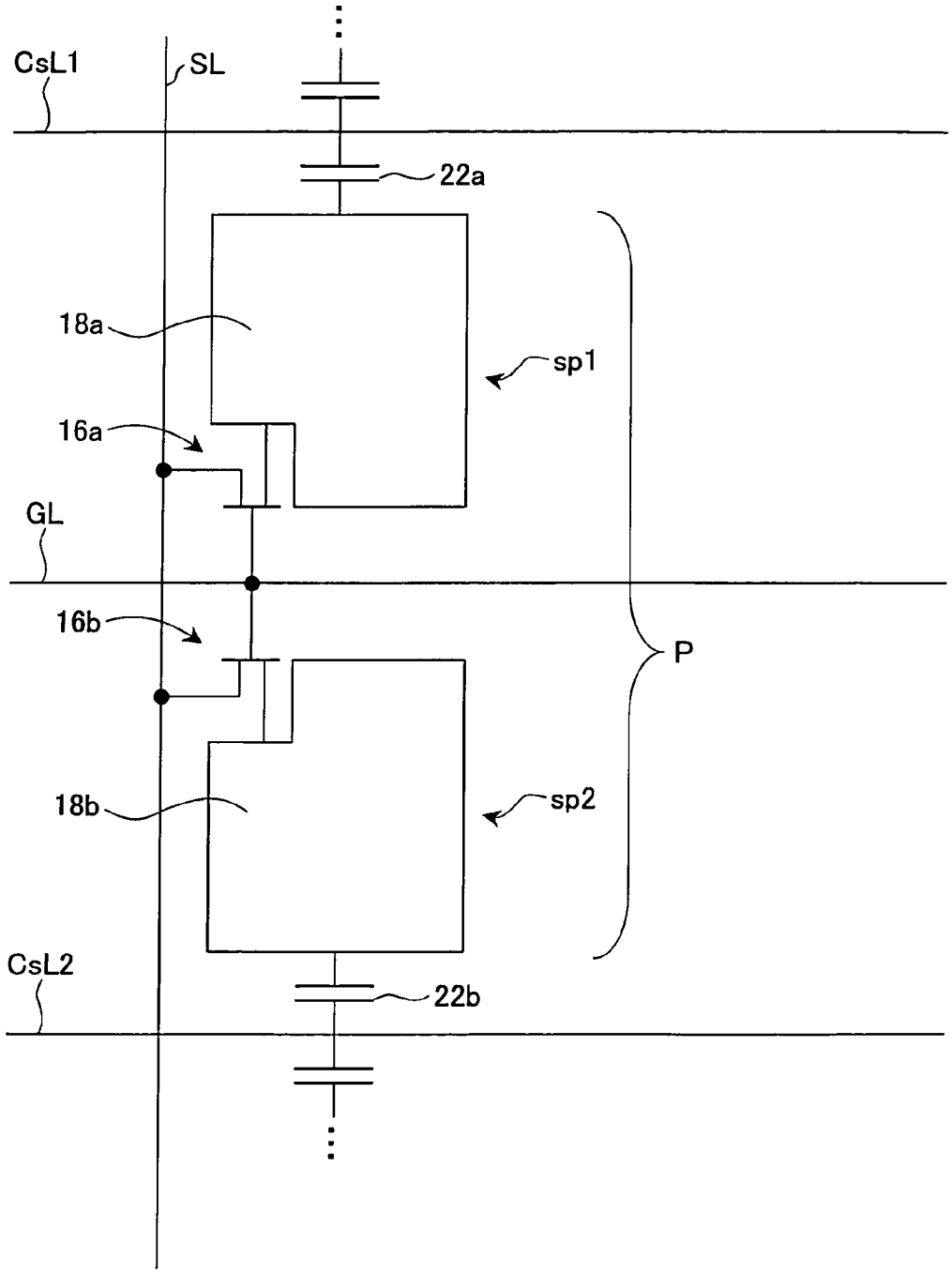
FIG. 7
Figure 8:
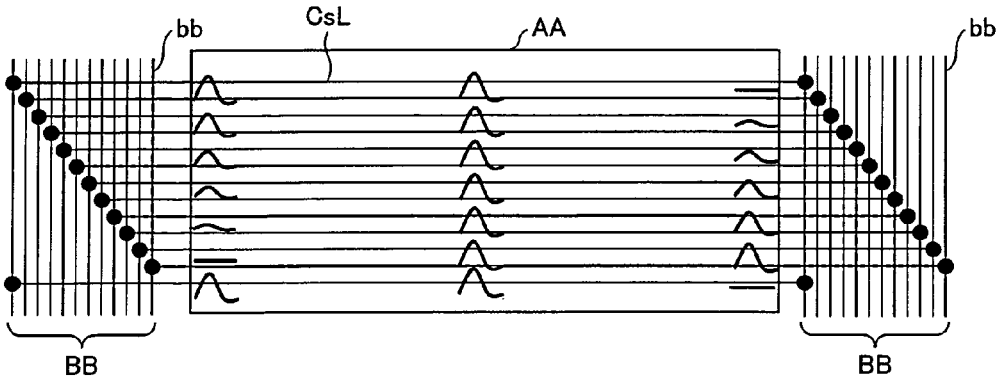
FIG. 8
Figure 9:
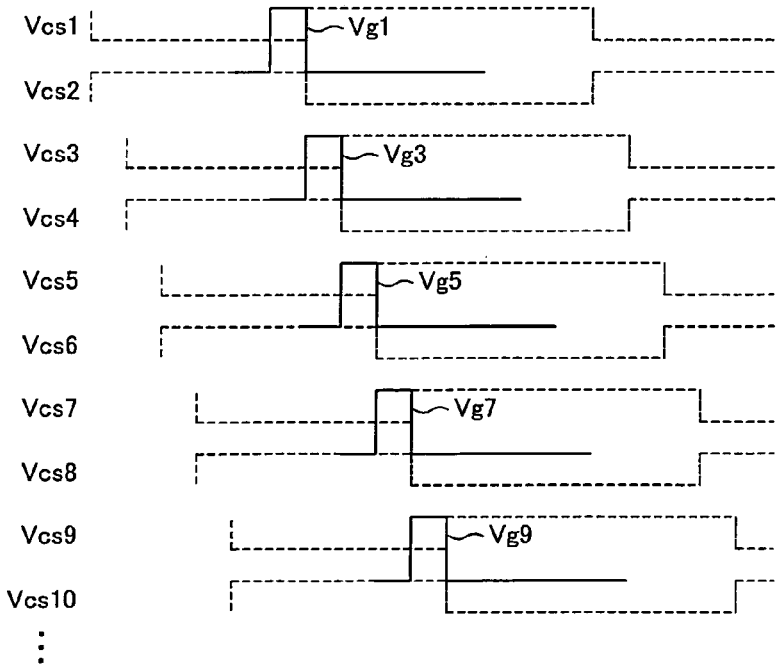
FIG. 9

The plurality of gate bus lines GL and the plurality of source bus lines SL are provided as in FIG. 7 so that (i) the plurality of gate bus lines GL cross the plurality of source bus lines SL and (ii) the plurality of gate bus lines GL and the plurality of source bus lines SL are connected to the pixels P. The storage capacitor bus lines CsL1 are each connected to corresponding ones of the sub-pixels sp1, whereas the storage capacitor bus lines CsL2 are each connected to corresponding ones of the sub-pixels sp2. One of the CS trunk line groups BB and BB is provided in a region which is adjacent to the active area AA on one side of a direction in which the storage capacitor bus lines CsL (referring collectively to the storage capacitor bus lines CsL1 and CsL2) extend. The other of the CS trunk line groups BB and BB is provided in a region which is adjacent to the active area AA on the other side of the direction in which the storage capacitor bus lines CsL extend. The storage capacitor bus lines CsL are connected to each of the CS trunk line groups BB and BB. Note that only one of the CS trunk line groups can alternatively be provided.

The source drivers SD and the gate drivers GD1 and GD2 are connected to the display panel 2 by SOF (system on film) technique. The present embodiment is arranged such that (i) the source drivers SD are connected to only a first side of the display panel 2, (ii) the gate drivers GD1 are connected to a second side of the display panel 2 which second side is one side that is orthogonal to the first side, and (iii) the gate drivers GD2 are connected to a third side of the display panel 2 which third side is the other side that is orthogonal to the first side. The source drivers SD and the gate drivers GD1 and GD2 are, however, not particularly limited in configuration. The source drivers SD are further connected to the SOF board 3 so that the source drivers SD each receive corresponding display data supplied from the SOF board 3.

The SOF board 3 is connected to the display control board 5 via the flexible wirings 4. The display control board 5 includes: a FPGA (field programmable logic array) 50; and timing controllers 51 and 52. The display control board 5 thus supplies: timing signals for use by the source drivers SD and the gate drivers GD1 and GD2; display data for use by the source drivers SD; and storage capacitor voltages for use by the CS trunk line groups BB and BB. The timing signals for use by the gate drivers GD1 and GD2 and the storage capacitor voltages for use by the CS trunk line groups BB and BB are supplied into the display panel 2 via the SOF board 3 and an area of a SOF package in which area the source drivers SD are mounted.

Figure 1:
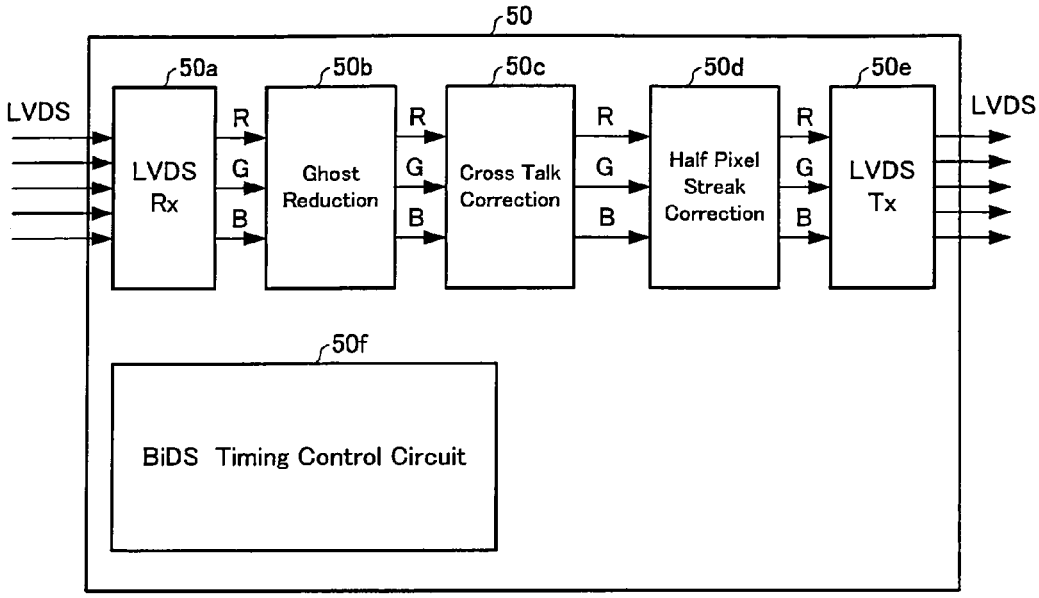
FIG. 1

FIG. 1 illustrates a configuration of the FPGA (correcting means) 50. The FPGA 50 can include an ASIC. The FPGA 50 includes: a LVDS receiver 50*a*; a ghost reduction section 50*b*; a cross talk correction section 50*c*; a half pixel streak correction section 50*d*; a LVDS driver 50*e*; and a BiDS timing control circuit 50*f*.

Figure 14:
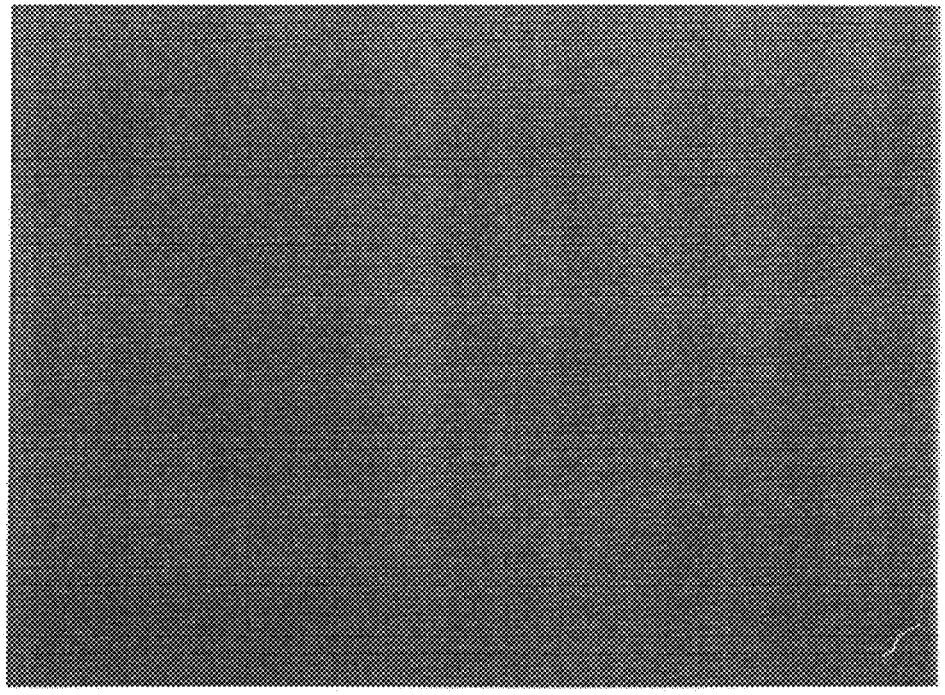
FIG. 14

The LVDS receiver 50*a* receives display data serially transmitted from a video image source by LVDS (low voltage differential signaling) method, and thus outputs in parallel respective display data sets of R, G, and B. The ghost reduction section 50*b* carries out processing for removing a ghost component from the display data. The cross talk correction section 50*c* corrects various cross talk caused on the display device. The half pixel streak correction section 50*d*, in a case where data signals are written to pixels during a unique horizontal period, carries out a gray scale correction with respect to display data corresponding to such data signals. This unique horizontal period is a horizontal period for a driving signal which horizontal period occurs a number of horizontal periods after a first horizontal period included in a given cyclic term, the number being different from those for other driving signals, for either or both of (i) high levels and (ii) low levels, during the above given cyclic term, of binary levels of respective driving signals CS1 to CS12 supplied to storage capacitor bus lines CsL. The half pixel streak correction section 50*d* has a function of eliminating a streak pattern (hereinafter referred to as "streaks of half pixels") illustrated in FIG. 14. The LVDS driver 50*e* receives the display data sets of R, G, and B which display data sets have been subjected to the gray scale correction and supplied from the half pixel streak correction section 50*d*, and thus supplies the display data sets in LVDS form to the timing controllers 51 and 52.

The BiDS timing control circuit 50*f* generates and outputs (i) driving signals CS1 to CS12, which are storage capacitor voltages for use in block inversion driving, and (ii) a signal for instructing polarity reversal of data signals.

Figure 2:
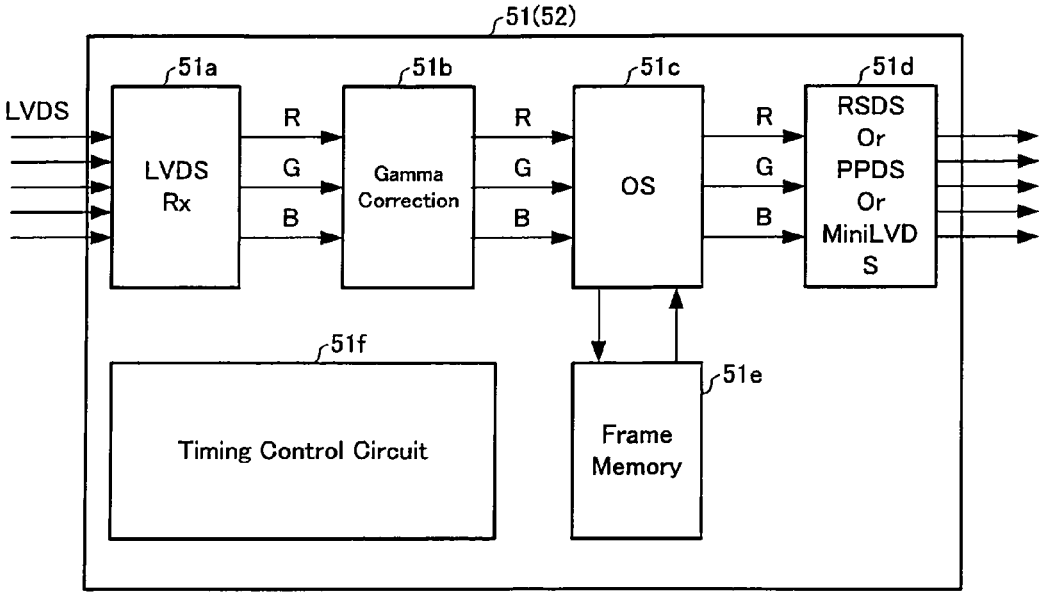
FIG. 2

FIG. 2 illustrates a configuration of the timing controllers 51 and 52. The timing controllers 51 and 52 share an identical configuration. The description below thus deals with only one of them, that is, the timing controller 51. The timing controller 51 processes signals and data for use by driving circuits and a trunk line group BB both provided in a first half of the display panel 2. The driving circuits include: the gate drivers GD1; and source drivers SD provided in a left half of FIG. 3. The timing controller 51 thus supplies the signals and the data to the above driving circuits and the trunk line group BB. The timing controller 52 processes signals and data for use by driving circuits and a trunk line group BB both provided in a second half of the display panel 2. The driving circuits include: the gate drivers GD2; and source drivers SD provided in a right half of FIG. 3. The timing controller 52 thus supplies the signals and the data to the above driving circuits and the trunk line group BB.

The timing controller 51 includes: a LVDS receiver 51*a*; a gamma correction section 51*b*; an on-screen mixer 51*c*; a data transmission driver 51*d*; a frame memory 51*e*; and a timing control circuit 51*f*.

The LVDS receiver 51*a* receives the display data sets of R, G, and B supplied from the LVDS driver 50*e*. The gamma correction section 51*b* receives the display data sets of R, G, and B from the LVDS receiver 51*a*, and carries out gamma correction with respect to the display data sets. The on-screen mixer 51*c* superimposes data such as subtitles, stored in the frame memory 51*e*, over a display screen. The data transmission driver 51*d* converts the display data sets of R, G, and B, supplied from the on-screen mixer 51*c*, into serial data suitable for transmission to the display panel 2, and outputs the serial data in a form of, for example, RSDS (reduced swing differential signaling), PPDS (point to point differential signaling), or MiniLVDS.

The timing control circuit 51*f* generates and outputs timing signals, such as clock signals and start pulse signals, which are used by the corresponding source drivers SD and the gate drivers GD1 (for the timing controller 52, the gate drivers GD2).

Figures 4, 5:
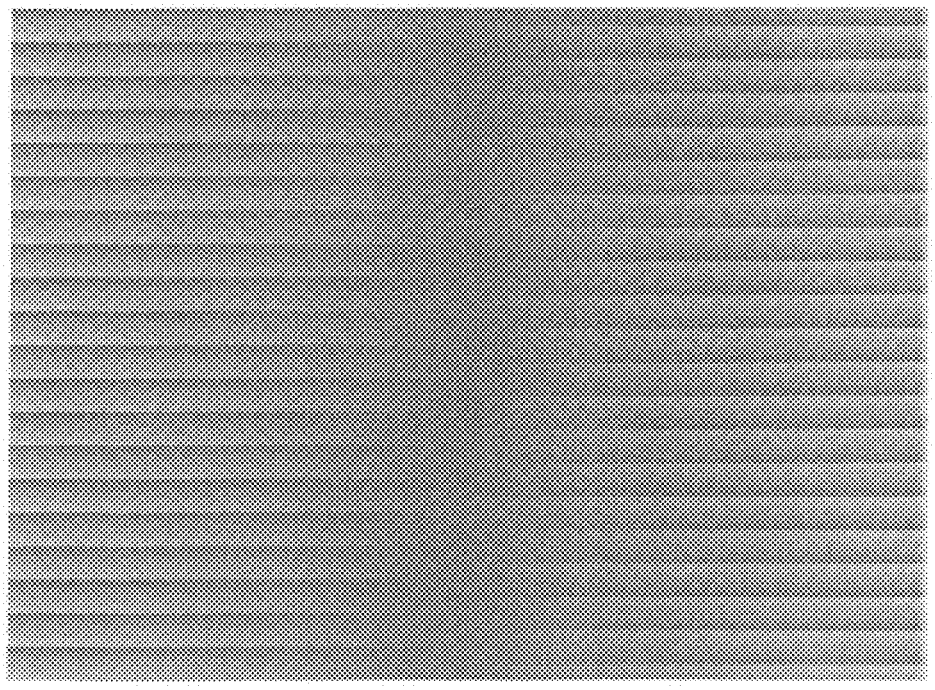
FIG. 4
FIG. 5

FIG. 4 illustrates in detail the gray scale correction of display data carried out by the half pixel streak correction section 50*d*.

The gray scale correction is carried out on the basis of an input gray scale of each of the display data sets of R, G, and B supplied to the half pixel streak correction section 50*d*. In a case where, for example, the input gray scale is expressed 10 bits, 1024 gray scales, the gray scale correction is carried out as follows: If the input gray scale falls within a range from 0 to 9, no correction is made. If the input gray scale falls within a range from 10 to 39, a correction for a 0.25 gray scale level increase is made. If the input gray scale falls within a range from 40 to 511, a correction for a 0.75 gray scale level increase is made. If the input gray scale falls within a range from 512 to 1023, no correction is made. As described above, a degree of correction, that is, a correction value, varies by a minimum unit of a quarter gray scale level, for example. This small unit of gray scale level is generated by controlling a frame rate.

The correction value shown in FIG. 4 varies depending on a range of gray scale. This variation arises from an aspect of a gamma curve for the display data. The correction value is large across a certain range from a middle gray scale level to a lower gray scale level (that is, on a black display side).

Figure 13:
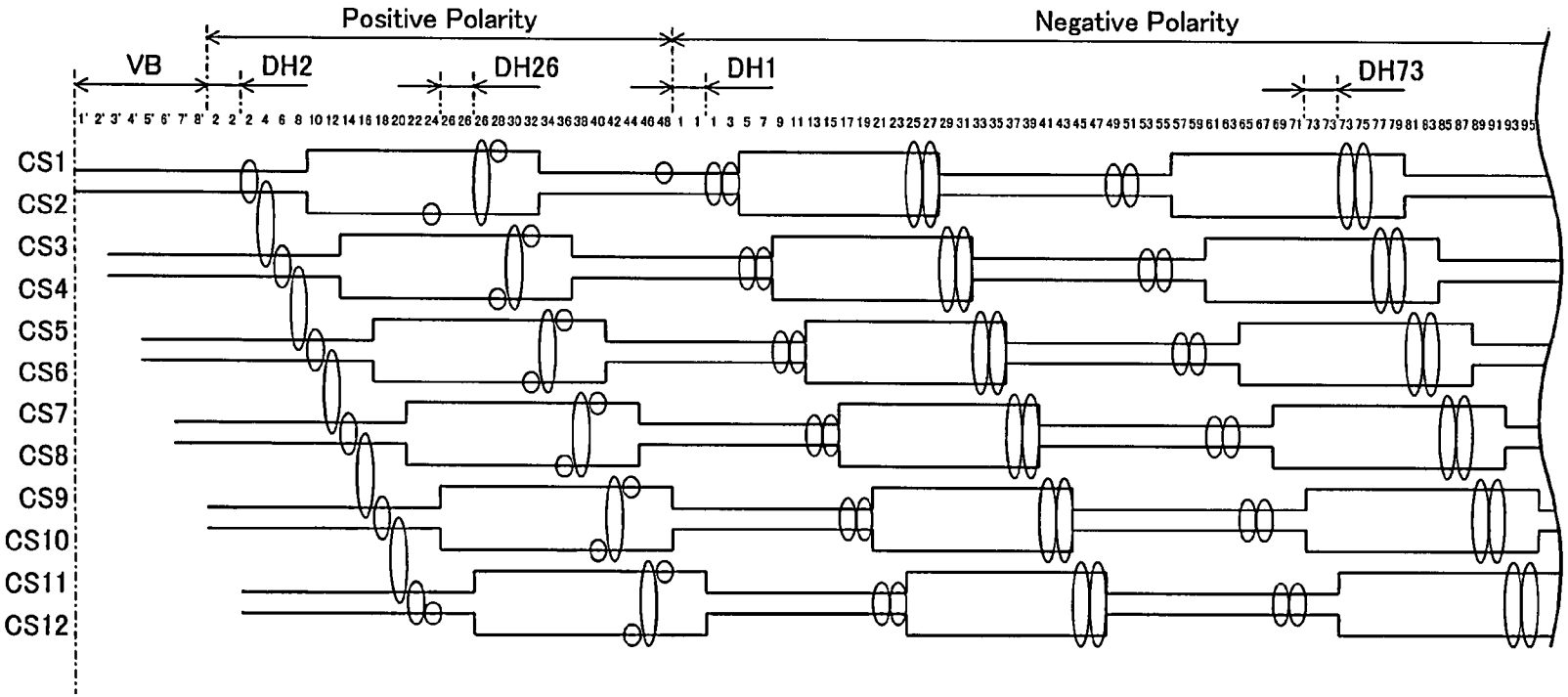
FIG. 13

By carrying out the above gray scale correction on the basis of an input gray scale, it is possible to carry out a gray scale correction with respect to display data corresponding to a data signal which is written to a pixel, such as the pixels PIX24 and PIX48, during a unique horizontal period as described with reference to FIG. 13. As such, an effective voltage applied across the liquid crystal layer of the pixel to which a data signal is written during the unique horizontal period within a given cyclic term, set for each of the driving signals CS1 to CS12, can be made substantially equal to those for other pixels PIX to which respective data signal are written during the given cyclic term. It follows that in a case where a uniform gray display is carried out on the display panel 2, it is possible to make luminances of all pixels substantially equal to one another. As a result, it is possible to eliminate the half pixel streaks.

In the above example, the multi-pixel driving is carried out with respect to the display panel 2, in which (i) each pixel is made up of a plurality of sub-pixels, and (ii) the sub-pixels of each pixel form respective storage capacitors with different storage capacitor bus lines. This arrangement can (i) eliminate the half pixel streaks and thus (ii) accurately improve, over a wide viewing angle, a gray scale reversal phenomenon involving the use of the plurality of sub-pixels.

In the above example, the unique horizontal period is set by setting, before a subsequent horizontal period during which a subsequent data signal is written to a pixel, a dummy horizontal period during which no data signal is written. The unique horizontal period is allocated, for writing of a data signal to a pixel, as a horizontal period which occurs a number of horizontal periods after a first horizontal period included in a given cyclic term, the number being different from those for other driving signals. As such, it is possible to (i) sufficiently secure, with use of the dummy horizontal period, a charging rate of a data signal line for a data signal having a reversed polarity, and thus (ii) eliminate the half pixel streaks.

In the above example, the half pixel streak correction section 50*d* carries out the gray scale correction with respect to the display data on the basis of an input gray scale of the display data supplied. This arrangement makes it possible to (i) make a particularly great correction to the input gray scale by which the half pixel streaks are highly likely to be visible, and thus (ii) particularly preferably eliminate the half pixel streaks.

Further, for rows other than rows including pixels to which data signals are written during the unique horizontal period, the half pixel streak correction section 50*d* can carry out a gray scale correction with respect to display data, corresponding to such data signals, in accordance with a row position on the display panel 2, of the pixels to which the data signals are to be written. As described above with reference to FIGS. 8 through 11, the storage capacitor bus lines CSL are connected to the respective CS trunk lines bb at positions which are different from one another in distance from the active area AA. As such, an interconnect delay is different among the storage capacitor bus lines CSL depending on which CS trunk line a storage capacitor bus line CSL is connected to. As a result, even in a case where a uniform gray display is carried out, a gradation such as a gradation illustrated in FIG. 5 may be visible in addition to the half pixel streaks. In such a case, the half pixel streak correction section 50*d* carries out gray scale corrections as indicated in (a) and (b) of FIG. 6, respectively. This allows an elimination of the gradation. This correction can include a correction for eliminating the half pixel streaks.

According to the gray scale correction illustrated in (a) of FIG. 6, a correction value varies depending on which row of a unit a pixel is provided on. In (a) of FIG. 6, the sign "+" indicates an increase in gray scale, whereas the sign "−" indicates a decrease in gray scale. With this arrangement, a gray scale correction can be carried out depending on the distance between the active area AA and the position at which each storage capacitor bus line CSL is connected to a corresponding CS trunk lines bb. As such, it is possible to eliminate the gradation in the column direction (scanning direction). According to the gray scale correction illustrated in (b) of FIG. 6, a correction value varies depending on positions of the pixels along a horizontal direction, that is, the column position, so as to eliminate the gradation visible depending on a distance from each pixel on an identical row and to a corresponding CS trunk line bb included in the display panel 2. In the gray scale correction of (b) of FIG. 6, the correction value is greater for a pixel closer to a corresponding CS trunk line bb.

The correction values shown in (a) and (b) of FIG. 6 are set as in FIG. 4.

The description of the present embodiment ends here.

In the above embodiment, the driving signals for the storage capacitor bus lines CsL each have a binary level including a high level and a low level. The present invention is, however, not limited to such an arrangement. The driving signals are in general simply required to each have a potential during a pixel selection period which potential has a binary level including a high level and a low level. The present invention can thus be implemented with use of a quaternary-level driving signal as follows: During a period other than the pixel selection period, the driving signal initially has a potential with a level after reversed from a low-level side to a high-level side which is higher than the high level, whereas the driving signal initially has a potential with a level after reversed from the high-level side to the low-level side which is lower than the low level. The quaternary-level driving signal, for example, overdrives the storage capacitor bus lines CsL and reduces the interconnect delay for lines such as the CS trunk lines bb and the storage capacitor bus lines CsL. Neither a period of the higher level (that is, an overshoot period) nor a period of the lower level (that is, an undershoot period) overlaps the unique horizontal period during a cyclic term, and thus causes no direct influence on the gray scale correction of the present invention.

The number of sub-pixels included in a single pixel can generally be two or more. Variation in the number of sub-pixels merely requires variation in the number of the storage capacitor bus lines CsL. As such, the arrangement of the present embodiment for uniforming the ripple voltages is applicable without a modification to the case where the number of sub-pixels is two or more.

The arrangement of the present embodiment is also applicable to a display device which employs a driving method other than the multi-pixel driving, such as a driving method in which a single storage capacitor bus line CsL is provided for each pixel, and the storage capacitor bus lines CsL are each connected to one of a predetermined number of CS trunk lines bb which are driven by driving signals that are different from one another.

The present invention is not limited to the description of the embodiment above, but may be altered in various ways by a skilled person within the scope of the claims. Any embodiment based on a combination of technical means appropriately altered within the scope of the claims is also encompassed in the technical scope of the present invention.

INDUSTRIAL APPLICABILITY

The present invention is suitably applicable to a liquid crystal television, for example.

Reference Signs List

1 liquid crystal display device (display device)
2 display panel
22*a*, 22*b* storage capacitor
50 FPGA (correcting means)
P, PIXpixel
SD source driver (display driver)
sp1, sp2, spa, spb sub-pixel
AA active area
CsL storage capacitor bus line
BB CS trunk line group
bb CS trunk line
CS1 to CS12 driving signal

The invention claimed is:

1. A display device comprising:

a plurality of pixels;

first storage capacitor bus lines each driven by a first driving signal;

second storage capacitor bus lines each driven by a second driving signal, each of the first driving signal and the second driving signal have a waveform in which, for each frame period, a polarity is reversed with respect to that of a reference potential for each set of a plurality of horizontal periods and a phase of the first driving signal is shifted from that of the second driving signal, data signals written to respective ones of the plurality of pixels are reversed in polarity for each set of consecutive horizontal periods within each frame and the plurality of pixels are such that the data signals which are reversed in polarity for the each frame are written respectively in the plurality of pixels; and correcting means for correcting a gray scale of display data of each of the data signals to be written in respective first pixels and supplying the display data to a display driver, when (i) each set of the plurality of horizontal periods during which the polarity of each of the first driving signal and the second driving signal is constant is one cyclic term, (ii) a first cyclic term of each of the first driving signal and the second driving signal in the each frame is a cyclic term of the frame, during which the data signals are first written respectively in the plurality of pixels which correspond to the respective first storage capacitor bus lines or the respective second storage capacitor bus lines, (iii) the first driving signal has a first polarity during a B-th horizontal period in an A-th cyclic period of the first driving signal, (iv) the B-th horizontal period in the A-th cyclic period of the first driving signal is allocated for writing of the data signals in the respective first pixels which correspond to the respective first storage capacitor bus lines driven by the first driving signal, (v) the second driving signal has the first polarity during the B-th horizontal period in the A-th cyclic period of the second driving signal, and (vi) the B-th horizontal period in the A-th cyclic period of the second driving signal is not allocated for writing of the data signals in any pixels of the plurality of pixels which correspond to the respective second storage capacitor bus lines driven by the second driving signal.

2. The display device according to claim 1, wherein:

the pixels each include a plurality of sub-pixels; and the sub-pixels of each of the pixels form respective storage capacitors with different ones of the first storage capacitor bus lines and the second storage capacitor bus lines.

3. The display device according to claim 1, wherein:

a dummy horizontal period during which the data signals are written in none of the plurality of pixels is set between the B-th horizontal period in the A-th cyclic term of the first driving signal and a subsequent horizontal period during which the data signals are to be written.

4. The display device according to claim 1, wherein:

the correcting means corrects the gray scale of the display data on a basis of an input gray scale of the display data supplied to the integrated circuit.

5. The display device according to claim 1, wherein:

the correcting means corrects the gray scale of the display data, corresponding to a second data signal, in accordance with a row position on a display panel, of a second pixel to which the second data signal is to be written.

6. The display device according to claim 5, wherein:

the correcting means further corrects the gray scale of the display data, corresponding to the second data signal, in accordance with a column position on the display panel, of the second pixel.

7. A method for driving a display device, the display device including a plurality of pixels, first storage capacitor bus lines each driven by a first driving signal and second storage capacitor bus lines each driven by a second driving signal, each of the first driving signal and the second driving signal having a waveform in which, for each frame period, a polarity is reversed with respect to that of a reference potential for each set of a plurality of horizontal periods and a phase of the first driving signal is shifted from that of the second driving signal, data signals written to respective ones of the plurality of pixels are reversed in polarity for each set of consecutive horizontal periods within each frame, and the plurality of pixels are such that the data signals which are reversed in polarity for the each frame are written respectively in the plurality of pixels, the method comprising:

correcting a grays scale of display data of each of the data signals to be written in the respective first pixels corresponding to the respective first storage capacitor bus lines driven by the first driving signal and supplying the display data to a display driver, when (i) the each set of the plurality of horizontal periods during which the polarity of each of the first driving signal and the second driving signal is constant is one cyclic term, (ii) a first cyclic term of each of the first driving signal and the second driving signal in the each frame is a cyclic term of the frame, during which the data signals are first written respectively in the plurality of pixels which correspond to the respective first storage capacitor bus lines or the respective second storage capacitor bus lines, (iii) the first driving signal has a first polarity during a B-th horizontal period in an A-th cyclic period of the first driving signal, (iv) the B-th horizontal period in the A-th cyclic period of the first driving signal is allocated for writing of the data signals in the respective first pixels which correspond to the respective first storage capacitor bus lines driven by the first driving signal, (v) the second driving signal has the first polarity during the B-th horizontal period in the A-th cyclic period of the second driving signal, and (vi) the B-th horizontal period in the A-th cyclic period of the second driving signal is not allocated for writing of the data signals in any pixels of the plurality of pixels which correspond to the respective second storage capacitor bus lines driven by the second driving signal.

8. The method according to claim 7, wherein:

the pixels each include a plurality of sub-pixels; and the sub-pixels of each of the pixels form respective storage capacitors with different ones of the first storage capacitor bus lines and the second storage capacitor bus lines.

9. The method according to claim 7, wherein:

a dummy horizontal period of any of the other driving signals by providing, before a subsequent dummy horizontal period during which no data signal is written to a pixel a dummy horizontal period during which the data signals are written in none of the plurality of pixels is set between the B-th horizontal period in the A-th cyclic term of the first driving signal and a subsequent horizontal period during which the data signals are to be written.

10. The method according to claim 7, wherein:

the correcting the gray scale of the display data is performed on a basis of an input gray scale of the display data supplied.

11. The method according to claim 7, wherein:

the correcting the gray scale of the display data is performed on a second data signal, in accordance with a row position on a display panel, of a second pixel to which the second data signal is to be written.

12. The method according to claim 11, wherein:

the correcting the gray scale is further carried out with respect to the display data, corresponding to the second data signal, in accordance with a column position on the display panel, of the second pixel.

13. A method for controlling display driving of a display device, the display device including a plurality of pixels, first storage capacitor bus lines each driven by a first driving signal and second storage capacitor bus lines each driven by a second driving signal, each of the first driving signal and the second driving signal having a waveform in which, for each frame period, a polarity is reversed with respect to that of a reference potential for each set of a plurality of horizontal periods and a phase of the first driving signal is shifted from that of the second driving signal, data signals written to respective ones of the plurality of pixels are reversed in polarity for each set of consecutive horizontal periods within each frame, and the plurality of pixels are such that the data signals which are reversed in polarity for the each frame are written respectively in the plurality of pixels:

the method comprising:

correcting a gray scale of display data of each of the data signals to be written in the respective first pixels corresponding to the respective first storage capacitor bus lines driven by the first driving signal and supplying the display data to a display driver, when (i) the each set of the plurality of horizontal periods during which the polarity of each of the first driving signal and the second driving signal is constant is one cyclic term, (ii) a first cyclic term of each of the first driving signal and the second driving signal in the each frame is a cyclic term of the frame, during which the data signals are first written respectively in the plurality of pixels which correspond to the respective first storage capacitor bus lines or the respective second storage capacitor bus lines, (iii) the first driving signal has a first polarity during a B-th horizontal period in an A-th cyclic period of the first driving signal, (iv) the B-th horizontal period in the A-th cyclic period of the first driving signal is allocated for writing of the data signals in the respective first pixels which correspond to the respective first storage capacitor bus lines driven by the first driving signal, (v) the second driving signal has the first polarity during the B-th horizontal period in the A-th cyclic period of the second driving signal, and (vi) the B-th horizontal period in the A-th cyclic period of the second driving signal is not allocated for writing of the data signals in any pixels of the plurality of pixels which correspond to the respective second storage capacitor bus lines driven by the second driving signal.

14. The method according to claim 13, wherein:

a dummy horizontal period during which the data signals are written in none of the plurality of pixels is set between the B-th horizontal period in the A-th cyclic term of the first driving signal and a subsequent horizontal period during which the data signals are to be written.

15. The method according to claim 13, wherein:

the correcting the gray scale of the display data is performed on a basis of an input gray scale of the display data supplied.

16. The method according to claim 13, wherein:

the correcting the gray scale of the display data is performed on a second data signal, in accordance with a row position on a display panel, of a second pixel to which the second data signal is to be written.

17. The method according to claim 16, wherein:

the correcting the gray scale is further carried out with respect to the display data, corresponding to the second data signal, in accordance with a column position on the display panel, of the second pixel.

* * * * *